US011213131B2

(12) United States Patent
Nardi et al.

(10) Patent No.: US 11,213,131 B2
(45) Date of Patent: Jan. 4, 2022

(54) SOFA, ARMCHAIR OR SIMILAR ARTICLE OF FURNITURE IN A KIT, AND MOUNTING METHOD FOR SUCH ARTICLE

(71) Applicant: NARDI S.P.A., Chiampo (IT)

(72) Inventors: Giampietro Nardi, Chiampo (IT); Raffaello Galiotto, Chiampo (IT)

(73) Assignee: NARDI S.P.A., Chiampo (IT)

( * ) Notice: Subject to any disclaimer, the term of this patent is extended or adjusted under 35 U.S.C. 154(b) by 0 days.

(21) Appl. No.: 16/968,630

(22) PCT Filed: Feb. 4, 2019

(86) PCT No.: PCT/IB2019/050851
§ 371 (c)(1),
(2) Date: Aug. 10, 2020

(87) PCT Pub. No.: WO2019/162782
PCT Pub. Date: Aug. 29, 2019

(65) Prior Publication Data

US 2020/0390243 A1 Dec. 17, 2020

(30) Foreign Application Priority Data

Feb. 20, 2018 (IT) ..... 102018000002874

(51) Int. Cl.
*A47C 7/42* (2006.01)
*A47C 7/16* (2006.01)
(Continued)

(52) U.S. Cl.
CPC ..... *A47C 7/42* (2013.01); *A47C 4/027* (2013.01); *A47C 7/16* (2013.01); *A47C 7/407* (2013.01);
(Continued)

(58) Field of Classification Search
CPC ..... A47C 7/42; A47C 7/407; A47C 7/541; A47C 4/027; A47C 7/16; A47C 7/546;
(Continued)

(56) References Cited

U.S. PATENT DOCUMENTS 704,590 A * 7/1902 Stimson et al. ..... E05D 7/1066 16/267
2,766,814 A * 10/1956 Sedlacek ..... A47C 7/22 160/371
(Continued)

FOREIGN PATENT DOCUMENTS

BE 904107 A * 5/1986 ..... A47B 91/00
BE 904109 A * 5/1986 ..... A47B 91/00
(Continued)

OTHER PUBLICATIONS

International Search Report and Written Opinion for Corresponding International Application No. PCT/IB2019/050851 (9 Pages) (dated Mar. 14, 2019).

*Primary Examiner* — Robert Canfield
(74) *Attorney, Agent, or Firm* — Lucas & Mercanti, LLP

(57) ABSTRACT

The present invention relates to the furniture field, in particular outdoor furniture; even more particularly, it relates to a kit configuration of a sofa, armchair, chair or similar item of garden furniture or interior furniture and the relative mounting method.

18 Claims, 5 Drawing Sheets

(51) Int. Cl.

| | |
|---|---|
| ***A47C 7/54*** | (2006.01) |
| ***A47C 4/02*** | (2006.01) |
| ***A47C 17/04*** | (2006.01) |
| ***A47C 7/40*** | (2006.01) |

(52) U.S. Cl.
CPC ..... *A47C 7/541* (2018.08); *A47C 7/546* (2013.01); *A47C 17/04* (2013.01); *A47C 4/028* (2013.01)

(58) Field of Classification Search
CPC ..... A47C 17/04; A47C 4/028; A47C 13/005; A47C 5/043; A47C 5/10
USPC ..... 297/16.2, 378.1, 378.12, 411.27, 411.3, 297/440.1, 440.14, 440.15, 452.11, 297/452.56, 452.63, 452.64, 35–37; 403/3, 4, 367, 409.1, DIG. 8
See application file for complete search history.

(56) References Cited

U.S. PATENT DOCUMENTS

| | | | | | |
|---|---|---|---|---|---|
| 2,963,761 | A * | 12/1960 | Haydock | F16B 2/22 | 403/188 |
| 3,245,715 | A * | 4/1966 | Gits | A47C 4/20 | 297/59 |
| 4,776,635 | A * | 10/1988 | Halliez | B61D 33/00 | 297/440.15 |
| 2010/0019549 | A1* | 1/2010 | Huang | A47C 4/02 | 297/170 |

FOREIGN PATENT DOCUMENTS

| | | | | |
|---|---|---|---|---|
| DE | 1529459 | A1 | 12/1969 | |
| DE | 2225380 | A1 * | 12/1973 | A47C 3/00 |
| DE | 8620412 | U1 | 9/1986 | |
| DE | 8713415 | U1 | 1/1988 | |

* cited by examiner

SOFA, ARMCHAIR OR SIMILAR ARTICLE OF FURNITURE IN A KIT, AND MOUNTING METHOD FOR SUCH ARTICLE

CROSS-REFERENCE TO RELATED APPLICATIONS

This application is a 371 of PCT/IB2019/050851, filed Feb. 4, 2019 which claims the benefit of Italian Patent Application No. 102018000002874, filed Feb. 20, 2018.

FIELD OF THE INVENTION

The present invention relates to the furniture field, in particular outdoor furniture; namely, it refers to a kit arrangement of a sofa, an armchair, a chair or a similar outdoor furniture article (being it clear that an indoor use of such an article is not excluded), and to a method for mounting the article.

BACKGROUND OF THE INVENTION

In the above-mentioned field, there is a constant need to always identify new technical solutions that allow to offer significant advantages both from the manufacturer's side (simplification of production methods, reduction and/or better functional management of the warehouse etc.) and from the user's side (greater and easier possibilities for customization, transport convenience, ease of assembly, improved or novel aesthetic results, etc.). Clearly, the two sides are closely related to each other and are reflected in each other, given that, for example, offering better prerogatives in terms of customization determines an advantage for both the user and the producer (generating an incentive to the purchase); or that the improvement of the warehouse management materializes productive economies that affect the sale price, and therefore determine savings for the customer/user; or, moreover, that from a mounting method that the consumer finds particularly simple, there results more efficient management of warehouse spaces, a rationalization of stocks, and economies in transport.

The search for such solutions has to generally take into account the style trends, which require to seek results in which the connection elements that are necessary to a stable and safe assembly of the product, are made as much hidden as possible, in order to achieve aesthetic results which are particularly pleasant in their cleanliness and linearity. Furthermore, it has to be considered the importance of attaining a satisfactory (and possibly high) seating comfort for the user, as well as a relatively basic mounting (and maintenance) operations, that can be performed with common tools by sales personnel lacking particular skills or a high degree of specialization in the field of furniture mounting, but even by the end user himself.

In this context, the outdoor furniture field has featured, in particular, some proposals according to which a piece of furniture such as a chair or a sofa is supplied in separate parts (seat and backrest), provided with quick connection systems (basically snap couplings or the like), to permit a relatively quick assembly of the article even by the user himself. However, to the best of the applicant's knowledge, none of these solutions proved itself capable of ensuring simplicity of assembly, stability and security of the connection, a full reversibility of the latter, and completely satisfactory results in terms of aesthetics.

SUMMARY OF THE INVENTION

The object of the present invention is indeed to provide a solution capable of effectively complying with all these requirements just mentioned, without excluding the achievement of other and important accessory results.

The surprisingly effective solution proposed herein concerns a kit of sofa, chair or armchair or similar article of furniture and a related mounting method which according to the invention have the essential characteristics of the attached independent claims. Further advantageous features are defined by the dependent claims.

BRIEF DESCRIPTION OF THE DRAWINGS

The characteristics and the advantages of the sofa, chair armchair or similar article of furniture in kit and relative mounting method according to the invention will become apparent from the following description of an embodiment thereof, given as a non-limiting example, with reference to the attached drawings in which.

DETAILED DESCRIPTION OF THE INVENTION

Figure 1:
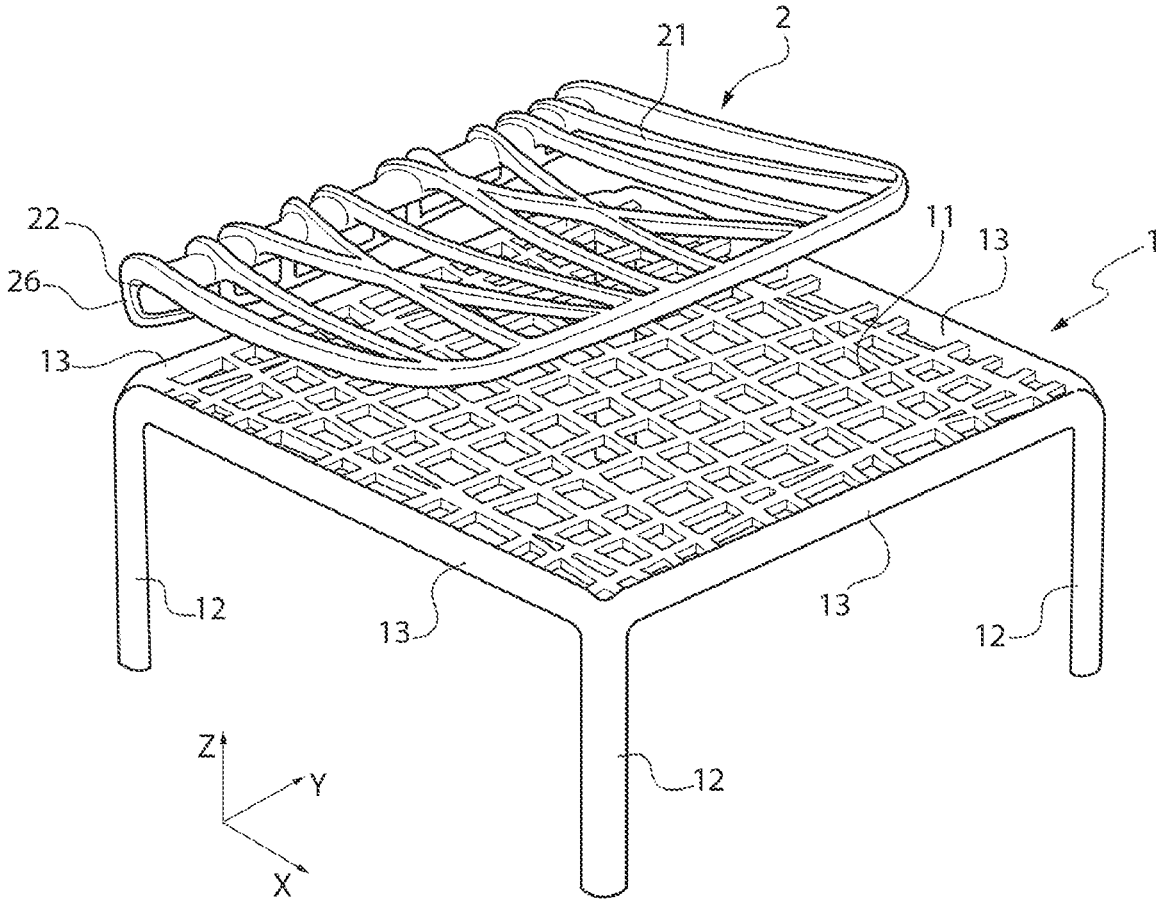
FIG. 1 is an axonometric view of a chair or sofa module kit according to the invention in a configuration that precedes mounting.

With reference to the above figures, a kit of a module of furniture article according to the invention provides a base 1, comprising a seat 11 supported by a frame 12 adapted to rest on the ground and to rise from it (four traditional legs as in the example or other equivalent structural solutions of a known type such as a tripod, a central upright, etc.).

The shape (in particular of the perimeter) and in general the configuration of the seat 11 may differ according to the most varied configurations, even if, normally, mesh configurations such as the one here shown are to be considered as advantageous. In any case, the seat extends over a geometric seating plane XY (X direction of depth, Y direction of width) and furthermore provides, according to the invention, at least along a segment of its perimeter, a bar 13 with a substantially elliptical or generally oval crosswise section. The bar 13 is exposed at least on three sides (upper, outer, lower) and a major axis Z' of its section is arranged orthogonally (as in the example) to the XY plane, or in any case closely to the orthogonal direction (angularly displaced by no more than about 20°), the latter being defined by means of a height reference axis or direction Z; in the present case (see in particular FIG. 4*a* among those in which the bar is seen in section), Z' is in fact parallel to the direction Z, but this does not apply in general.

Besides to the major axis Z', a minor axis X' can be distinguished, the length of which preferably has a ratio between about ⅓ and about ⅔ with respect to the major axis, even more preferably measuring about half of the greater axis. This minor axis X', orthogonal to the major axis, is staggered upwards with respect to the geometric seating plane XY (considering the width of the seat, such geometric plane will be the median plane of the seat in the sense of the width), whereby the oval of the bar has a development that is somewhat greater above the seat itself.

According to a typical (but not limitative) solution, the seat 11 is quadrilateral (in particular, rectangular) and at least one of the sides, intended to be the back side, is equipped with the above-mentioned bar, which—as discussed hereafter—is intended for securing a backrest 2 to the seat.

Such typical solution is shown in the armchair of the example here depicted, which however, according to a specific and particularly interesting embodiment, presents, in addition to a bar 13 along the back side, other alike bars 13 on the two hip sides, for connection of respective armrests 3 to be secured therefore to the seat 11 with the same system as the backrest and which will be described in detail hereafter. The bar can clearly be provided even on all sides (again, as shown in the present embodiment), allowing a modular choice on which sides to be mount a backrest and armrests, and which ones to leave free.

Referring to the backrest component 2, but analogous considerations apply to the armrest component or components, it has a backrest body 21 of a generally flat development and a configuration, here again, substantially of any nature, determined by the aesthetic and functional design choices and extraneous to the aspects that are relevant to the present invention. Along a lower side adapted to correspond with the bar 13, the backrest body 21 has a claw appendix arrangement, comprising a tubular member 22 which extends with its longitudinal axis Y" according to a width direction, and comprising an inner surface that defines a bore 23 which, in crosswise section, has a profile which matches the external profile of the bar at least along the upper side, lower and outward side of the bar, being thus adapted to realize a tight-fit coupling with the same bar.

Figure 4A:
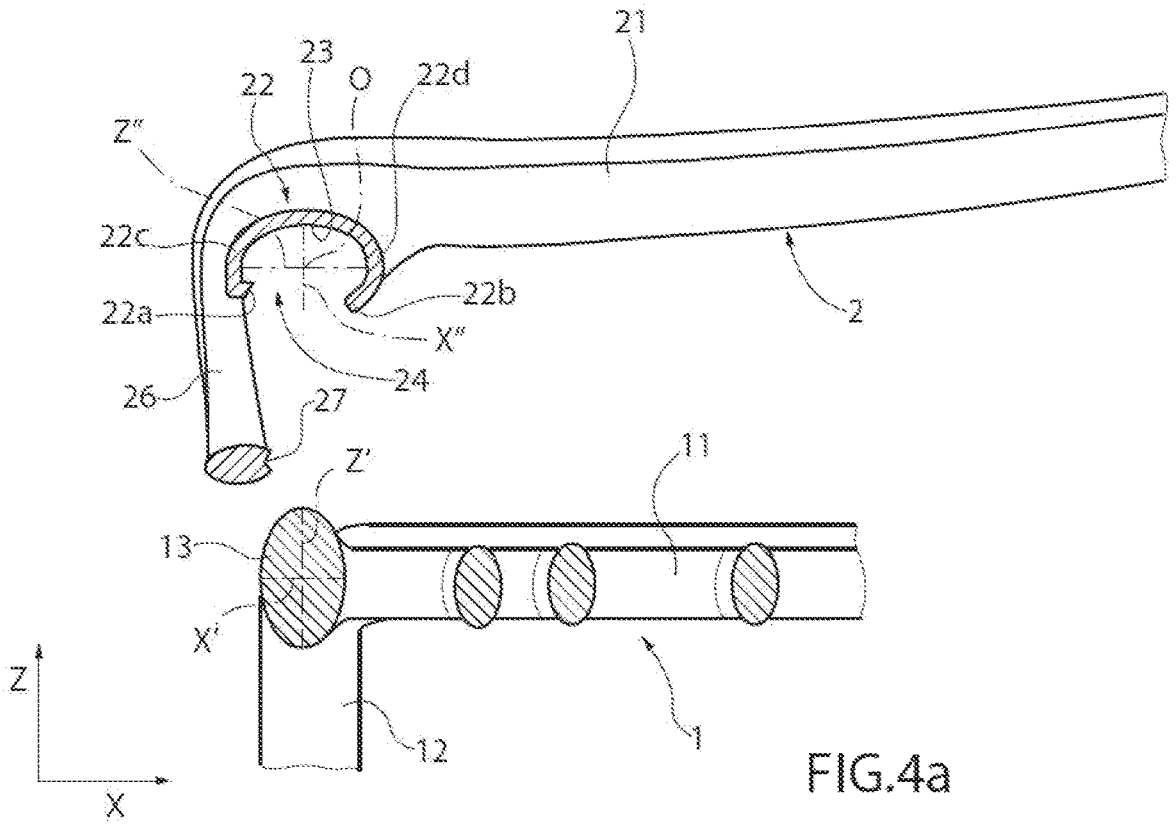
FIGS. 4*a* to 4*d* are sectional, schematic and partial views of the module of the previous figures, taken according to a plane orthogonal both to the seating plane and to the backrest when in the upright position, the views showing respective subsequent steps of the mounting procedure according to the invention.

Thus, the section of the bore 23, as indicated only in FIG. 4*a* for the sake of illustrative clarity, presents a major axis Z" and a minor axis X" which mutually cross at a center O on the longitudinal axis Y", preferably staggered with respect to the median geometric plane of the body 21 (i.e. the plane which is median with respect to the body thickness or depth direction), towards a front face 21*a*, which is the face adapted to support the back of a sitting user and therefore to overlook the volume above the seat 11.

Figure 4B:
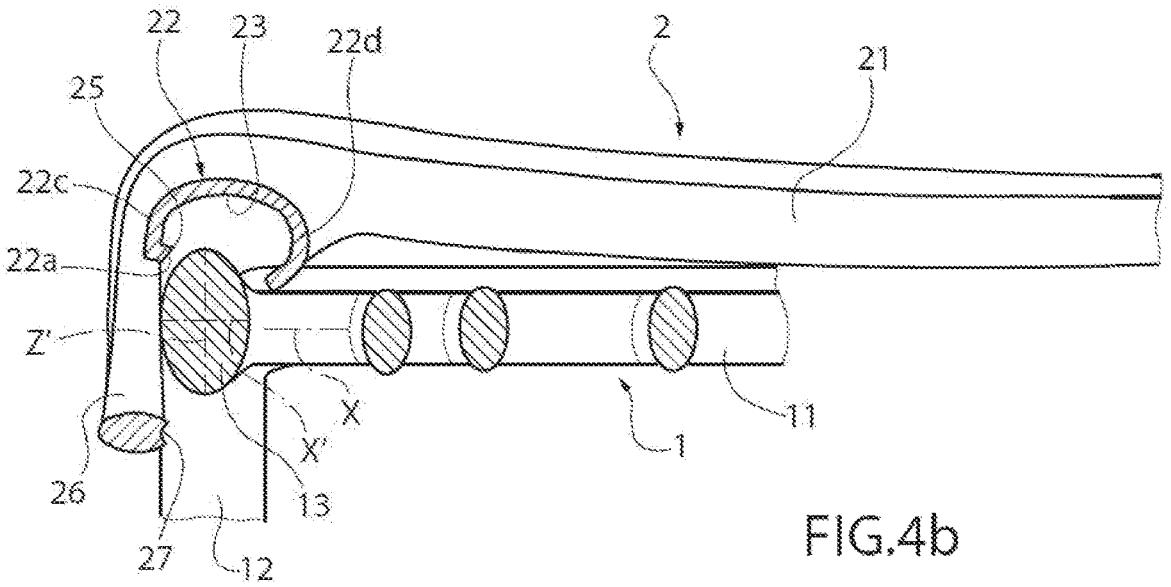
Figure 4C:
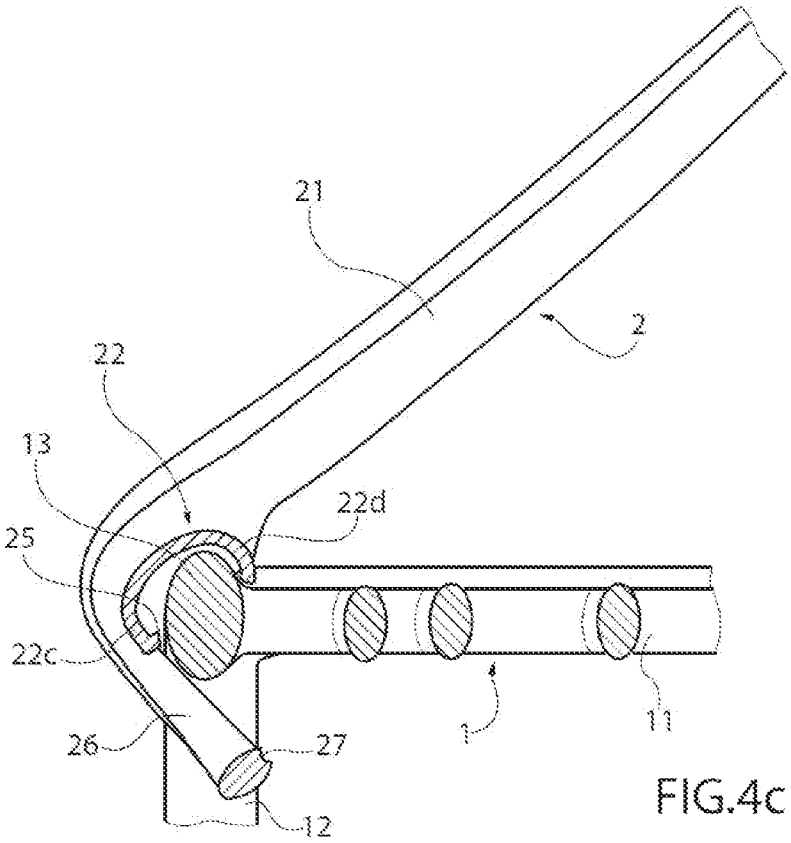
Figure 4D:
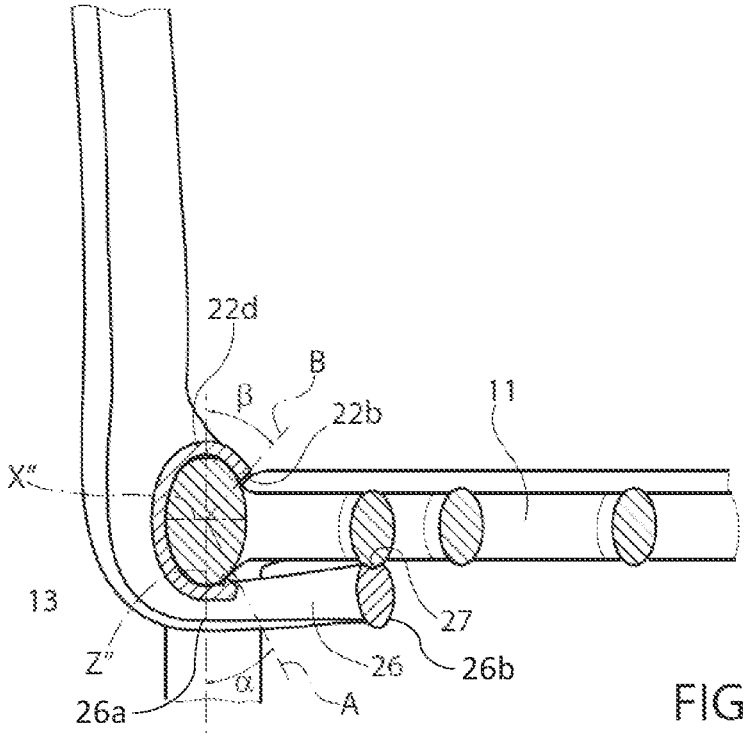

The bore 23 of the member/claw 22 is then open at an inner side through a wide slit 24, running along the longitudinal axis Y", that is according to the direction of the axis of the tubular member which is adapted to correspond to the width direction Y of the seat 11. The provision of the slit 24 gives the member 22 a substantially C-shaped section. More precisely, the slit extends in height (i.e. parallel to the major axis Z") between a lower edge 22*a* and an upper edge 22*b*. Taking as a reference the plane Y"-Z", as represented in FIG. 4*d*, the lower edge 22*a* lies over a first radial plane A which originates from the axis (and therefore in section from the center O) towards the front side and downwards, inclined by an acute angle $\alpha$ comprised between about 10° and about 30° with respect to the aforesaid plane Y"-Z", while the upper edge 22*b* lies over a second radial plane B which originates from the axis, again towards the front side but upwards, inclined by an acute angle $\beta$ between about 20° and about 40° with respect to the same plane Y"-Z".

As a result of this configuration, the tubular member has a lower portion 22*c* and an upper portion 22*d*, mutually non-symmetrical and corresponding to the two end arms of the C-shape. The upper portion 22*d* follows the oval curvature, extending to some extent over the front side ending with the upper edge 22*b* and assuming the physical configuration of a beam fixed at one end (base of the backrest) and free to the other (the aforementioned upper edge 22*b*). The lower portion 22*c*, besides being shorter than the upper portion, has a development that departs from the oval curvature and takes in fact a substantially tangential development, the lower edge 22*a* being about at the same level as the lower end of the major axis Z". On the lower portion, for example near the edge, there is, however, a projection 25 which protrudes towards the interior of the bore 23 and is adapted to snap into engagement on the outside of the bar 13, as will be clarified shortly hereafter.

The claw-shaped appendix of the backrest 2 (and, alike, of one or each of the armrests, if provided) is completed by a wing 26 extending from the lower portion 22*c* of the member 22 beyond the lower edge 22*a* and below it, towards the front (this spatial reference is still the one consistent with the orientation of the backrest face contacting a seated user, but more generically—as far also the armrest is concerned—one could also speak of internal direction, inasmuch it is the direction overlooking the internal region of the seat). The wing 26 is angled and extends suitably, to carry out a stop action on the lower face of the seat when the backrest is in the upright position. This result is normally achieved with a wing 26 which extends over a plane which is substantially orthogonal with respect to the backrest body 21, but variations of angle can be contemplated according to the desired inclination for the backrest body in the position of use. The extension length, measured in the X" direction between a root point 26*a* (at the lower end of the major axis Z") and a free end 26*b*, can be, for example and with no limiting purpose, between 3 and 5 times the length of the minor axis X".

For reasons that are both functional and aesthetic, the wing 26 can advantageously have a mesh-like structure that matches the mesh of the seat 11, whereby the wing remains hidden below the seat, looking from above, causing no visual disturbance. Seeking maximum safety and a precise reference, the wing 26, for example at its free end outline, can be provided with a shaping, such as a notch 27 shown in the present embodiment, suitable for male-female fitting with a corresponding part of the seat, so that when the wing abuts on the seat, a greater and more stable contact surface is obtained. Still for the sake of a more precise and stable match, and consequently also of an increased comfort of the seat, mutually coupling ridges/recesses can further be formed between the bar and the tubular member 22 (not represented here, but obviously understandable), suitable for preventing displacements in the direction of the common longitudinal axis of bar and member.

The material of which all the components described above are made is a rigid material, but nevertheless provided with a certain elastic deformability where sized with relatively thin walls and with a certain elongation from a fixed point, as in the region of the upper portion 22*b* which must actually be banded to some extent in order to allow the mounting. A particularly suitable material is polypropylene loaded with glass fiber, a material already commonly used in outdoor furniture, but other materials of equivalent behavior, as well known to experts in the field, can be equally used. It should also be noted that, although from a production point of view the most sensible solution is to manufacture all the parts by molding in the same material, from a strictly functional point of view nothing prevents a selective the use of a material such as the one indicated, that is with a certain elastic deformability, for e.g. the tubular member 22 only, being it the "active" component in the coupling system between the seat and the backrest.

The mounting of the backrest (or of an armrest) on the seat is carried out as follows. The body 21 of the backrest is arranged substantially parallel to the seat 11 above it, causing the slit 24 of the tubular member/claw 22 to be in correspondence and alignment with the bar 13 (FIG. 4*a* and FIG. 1). At this point the backrest is moved towards the seat causing the bar 13 to become partially housed in the bore 23 through the slit 24 (FIG. 4*b*). In this condition, the major axis Z" of the section seat is oriented substantially parallel (or in any case relatively close to the parallelism) with respect to the minor axis X' of the bar section.

Figure 2:
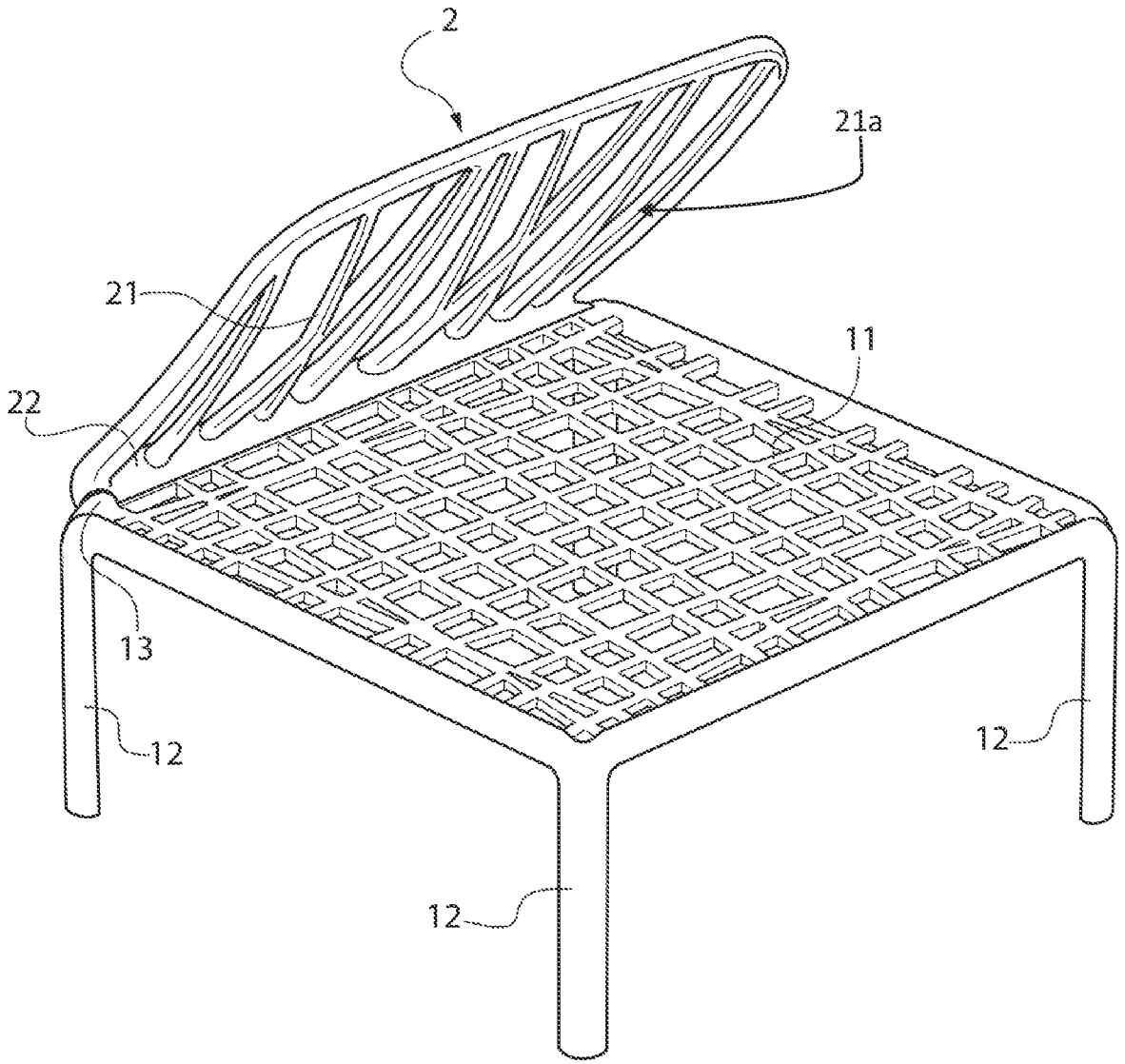
FIG. 2 and FIG. 3 are axonometric views of the armchair or sofa module of FIG. 1, respectively in an ongoing mounting configuration and in a mounted configuration (also provided with an armrest)

At this point, by driving the backrest into rotation around the bar, making the body 21 lift up towards the upright position, taking advantage of the width of the slit 24, the upper portion 22*d*, and in particular the relative upper edge 22*b*, is propped against the front (or inner) side of the bar. Assisted by the controlled flexion of the material, the lower portion 22*c* overlaps the lower part of the bar (FIG. 4*c* and FIG. 2), until snapping into the mounted position, in which the bar and the bore become tight-fit coupled, bringing into perfect match the two respective oval sections (external profile of the bar, inner profile of the bore). The operation is also assisted by the slightly upwards staggering of the bar 13 with respect to the geometric seating plane XY.

Figure 3:
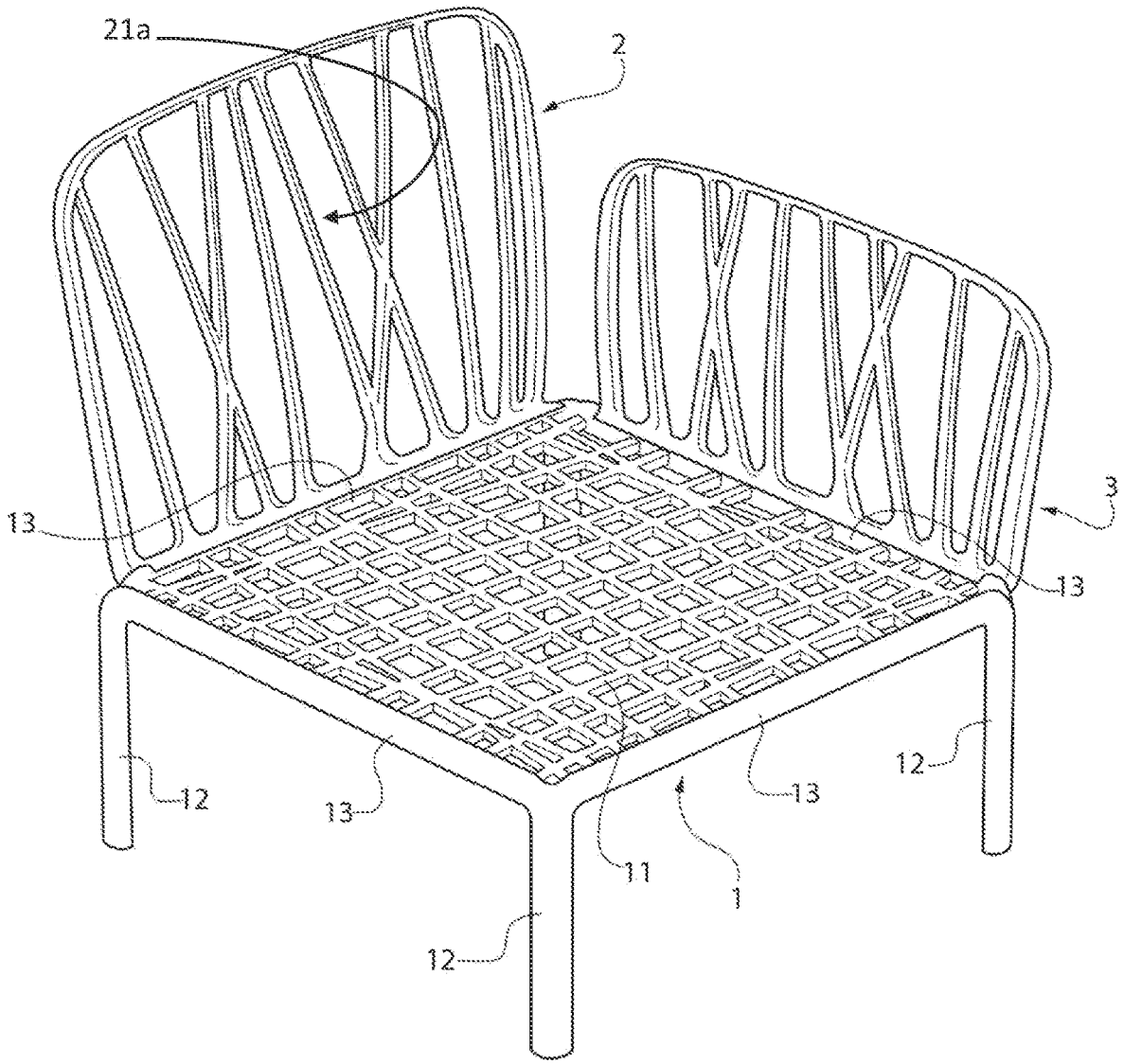

In this final position (FIG. 4*d* and FIG. 3, in which an armrest is also visible when mounted) the projection 25 of the lower portion 22*c* of the member 22 is forced on the bar exerting a contrast to the rotation opposite to that of assembly and therefore acting as a stabilizing factor. The wing 26 has also come into contact with the lower face of the seat, and this determines a safe stop to the rotation (in this case the rotation in the same mounting direction), also transferring to the seat the load that the seated user will exert by leaning on the backrest.

The connection can be, as normally the case, further stabilized and made even safer by inserting screws into suitably arranged holes, as obviously understandable and not illustrated in detail. In particular, screws which engage in holes formed in the wing 26 and lock in the lower part of the seat 11 will ensure a stop action with respect to stresses on the backrest (or armrest) that could rotate it in the opposite direction to that of mounting; i.e. the sense of the backrest dropping onto the seat.

It will be easily appreciated from the foregoing that the mounting system for the backrest and armrest of the sofa, chair or armchair according to the invention is capable to achieve remarkable advantages in terms of modularity and convenience. It is in particular apparent that one can advantageously reduce the packaging bulk and warehouse stocks, since the elements (base with seat, armrest, backrest) can be packaged and managed separately, allowing the formation of the final arrangement of the furniture piece according to the customer choices.

The mounting is simple, not requiring special skills or tools, and can therefore be carried out not only by technically unskilled warehouse or sales staff, but also and more importantly by the same customer, taking advantage of the easy transportability of the article, purchased as a kit of unmounted elements, at the same time being fully satisfied from the point of view of the aesthetic and functional quality of the resulting (mounted) product. The aesthetics of the piece of furniture is in fact extremely clean and elegant, without exposing any unattractive fastening means, or any other attachment features that would be perceived as extraneous to the styling of the article.

The product can be customized also in terms of color choices (different between base and backrest/armrests), even post-sales (replacement of individual components). A seat module such as the one here illustrated can then be used to compose sofas of length and development at will, connecting in series a plurality of seats 11 through common connecting clips between bars of adjacent modules, and then completing the article with the arrangement of backrests and armrests where appropriate. The product can clearly be completed by arranging cushions and coverings generally suitable to increase comfort, here again to be customizable and possibly to be sold in kit with the other components and/or individually.

Thanks to its reversibility, the mounting system also facilitates easy disassembly, by operating in reverse order with respect to the mounting sequence; this option can be exploited to better transport the item from one environment to another or to store it with less space, for example in a garage in winter months.

The present invention has been so far described with reference to its preferred embodiments. It has to be understood that other embodiments may exist which belong to the same inventive concept as defined by the scope of the protection of the claims here enclosed.

The invention claimed is:

1. A kit for obtaining a module of a sofa, chair or armchair furniture article, comprising:

a base with a seat extending over a geometric seating plane (XY), and a backrest or armrest component comprising a body defining an inner side adapted to face a user sitting on said seat, said base and said component being adapted to be mutually connected through mutual connection means arranged on at least a peripheral segment of said seat and on a corresponding lower side of said body, wherein said connection means comprise:

a bar having a generally oval crosswise section, arranged along said peripheral segment of said seat, and exposed at an upper side, a lower side and an outer side, said section having a major axis (Z') orthogonal or close to orthogonal with respect to said seating plane (XY); and a claw arrangement comprising:

a tubular member arranged along said lower side of said body, having a C-shaped crosswise section, forming a bore opened through a slit at an inner side, said crosswise section being generally oval to substantially match the section of said bar at least over said upper, outer and lower sides, and a wing projecting inwards from a lower side of said tubular member; said tubular member being configured in an elastically deformable fashion;

whereby said component is adapted to be mounted on said base by first setting said inner side close to said seat and housing said bar inside the bore of said tubular member through said slit, and then by rotating the component to a mounting position in which a tight coupling between the bore and the bar is obtained, causing the two respective oval sections to match, and said wing abuts against a lower face of said seat.

2. The kit according to claim 1, wherein the oval section of said bar and of said bore has a minor axis (X', X") and a major axis (Z', Z") having a length ratio comprised between about ⅓ and about ⅔.

3. The kit according to claim 2, wherein said ratio is about ½.

4. The kit according to claim 1, wherein said slit of said member extends along said major axis (Z") between a lower edge and an upper edge lying respectively over a first radial plane (A) originating from a central axis (O) of the bore, downwards inclined by an acute angle (α) comprised between about 10° and about 30° with respect to an elevation plane (Y"Z") defined by said central axis (O) and by the major axis (Z"), and over a second radial plane (B) originating from said central axis (O) and inclined upwards by an acute angle (β) comprised between about 20° and about 40° with respect to the same elevation plane (Y"Z").

5. The kit according to claim 1, wherein said tubular member comprises a lower portion from which said wing projects, having a development that departs from the oval curvature by taking a substantially tangential development, and an upper portion having a greater extension than the lower portion and following the oval curvature of the section towards the inner side, thus taking on the physical configuration of a beam fixed to a base end of said body.

6. The kit according to claim 5, wherein said lower portion has a protrusion that points towards the interior of said bore and is adapted to clamp said bar on the outside.

7. The kit according to claim 1, wherein said minor axis (X') of the section of said bar is staggered upwards with respect to said seating plane (XY), whereby the oval of the bar develops to a greater extent above said seating plane.

8. The kit according to claim 1, wherein said seat has a mesh structure, said wing having a mesh structure that match those of the seat, whereby in said mounting position the wing remains hidden behind the seat.

9. The kit according to claim 1, wherein said wing has a shaping fitting with a corresponding part of said seat in said mounting position.

10. The kit according to claim 1, wherein said bar and said tubular member comprise one or more ridges/recesses adapted to be mutually coupled to prevent displacements between said bar and said tubular member in a common longitudinal direction.

11. The kit according to claim 1, said wing is locked to said seat in said mounting position.

12. The kit according to claim 1, wherein said seat has a polygonal periphery, said bar or bars being provided along a side, more than one side or all the sides of said polygonal periphery.

13. The kit according to claim 12, wherein said seat has a quadrilateral periphery, said bar or bars being provided along a back side and/or a hip side of said quadrilateral periphery.

14. The kit according to claim 1, wherein said module comprises one backrest component and an armrest component.

15. The kit according to claim 1, comprising two or more of said modules mutually connected to two or more bases in series by acting on the relative bars when set close to each other.

16. A method for obtaining a furniture article according to claim 1, wherein a component is mounted on said base, the mounting of each component comprising the steps of:

setting the body of the component in a substantially parallel fashion to said seat above it, causing said slit of the tubular member to become in correspondence and aligned with said bar;

displacing said body towards the seat causing said bar to become partially housed inside said bore through said slit; and rotating the component around said bar, causing said body to lift up until said tubular member snaps in a position of tight fit coupling and mutual match between the oval sections of said bore and said bar, and said wing to abut against a lower face of said seat.

17. The method according to claim 16, wherein said wing is locked to said seat.

18. A sofa, chair or armchair furniture article obtained with the method according to claim 16.

* * * * *